United States Patent [19]

Nowak et al.

[11] Patent Number: 4,592,569

[45] Date of Patent: Jun. 3, 1986

[54] RELEASE SKI BINDING

[75] Inventors: Gerhard Nowak, Biedermannsdorf; Alfred Winter; Hans P. Morbitzer, both of Vienna; Klaus Kruschik, Gumpoldskirchen; Robert Taucher, Podersdorf, all of Austria

[73] Assignee: TMC Corporation, Baar, Switzerland

[21] Appl. No.: 561,715

[22] Filed: Dec. 15, 1983

[30] Foreign Application Priority Data

Dec. 16, 1982 [AT] Austria ..... 4571/82

[51] Int. Cl.[4] ..... A63C 9/081; A63C 9/085

[52] U.S. Cl. ..... 280/624; 280/625; 280/626

[58] Field of Search ..... 280/613, 616, 617, 618, 280/624, 625, 628, 634

[56] References Cited

U.S. PATENT DOCUMENTS

| | | | |
|---|---|---|---|
| 4,095,814 | 6/1978 | Weigl | 280/618 |
| 4,165,883 | 8/1979 | Weigl | 280/618 |
| 4,394,032 | 7/1983 | Storandt | 280/618 |
| 4,415,176 | 11/1983 | Hull | 280/624 |

FOREIGN PATENT DOCUMENTS

| | | |
|---|---|---|
| 2324078 | 11/1974 | Fed. Rep. of Germany . |
| 2401729 | 7/1975 | Fed. Rep. of Germany . |
| 2649826 | 6/1977 | Fed. Rep. of Germany . |
| 3026918 | 7/1980 | Fed. Rep. of Germany . |

*Primary Examiner*—John J. Love
*Assistant Examiner*—Joseph McCarthy
*Attorney, Agent, or Firm*—Flynn, Thiel, Boutell & Tanis

[57] ABSTRACT

A release ski binding has a sole plate which is pivotal in its central region about an approximately vertical axis and is tiltable up about a transverse axis which is arranged in front of the vertical axis, which sole plate is held in the skiing position by a resilient holding mechanism which, during a release, effects an opening of the jaws which hold the ski show on the ski.

In order to bring about a simple structural design of the binding, the holding mechanism has associated with it a spring housing which is movably supported on the sole plate, the spring of which spring housing urges a locking member for the jaws into the clamping position. The locking member is arranged on the sole plate.

11 Claims, 6 Drawing Figures

RELEASE SKI BINDING

FIELD OF THE INVENTION

The invention relates to a release ski binding comprising a sole plate, which in its central region is pivotal about a generally vertical axis and tilted up about a transverse horizontal axis which is arranged in front of the vertical axis, which sole plate, in the skiing position, is held on the ski by a resilient holding mechanism responsive to a swivelling movement of the sole plate relative to the ski which upon reaching a predetermined angle of traverse effects both an upwardly and also a side opening of a locking mechanism.

BACKGROUND OF THE INVENTION

Such release ski bindings are described in German Pat. No. 25 33 337. In these conventional ski bindings, the spring of the holding mechanism acts through a piston onto a generally mushroom-shaped follower member swingably supported for movement to all sides in the housing of the holding mechanism. The stem part of the mushroom-shaped follower member is received in a recess in a ski-fixed fitting. In these conventional ski bindings, the ski shoe is held at its tip by means of a rigid bar on the sole plate. In the case of a fall of the skier rearwardly, the ski shoe is therefore released only with great difficulty.

The aforementioned disadvantage is avoided in the ski binding disclosed in German Pat. No. 23 24 078, however, this binding is very complicated in its design. Further, the release mechanism is housed in the space between the base plate and the sole plate. However, this requires special sealing measures to protect against the penetration of snow and dirt. Furthermore the mounting is complicated and expensive.

The goal of the invention is to overcome the listed disadvantages of the conventional designs and to provide a release ski binding of the above-mentioned type, which is simple in its design and is inexpensive to manufacture and which opens also during rearward falls of the skier.

This goal is inventively achieved primarily by the holding mechanism having associated with it a spring housing which is movably supported on the sole plate, the spring of which housing urges a locking member for the jaws which hold the ski shoe into the clamping position. The locking member is arranged on the sole plate. If in this ski binding, the elastic range of the sole plate is exceeded, the spring housing is released by the holding mechanism, and the locking member is pulled back to open the jaws to release the ski shoe. Thus in every case, regardless of which direction the fall of the skier occurs, a release of the ski shoe is caused.

It has been proven to be particularly preferable if, in a further development of the invention, a two-arm lever is pivotally supported on a transverse axis in the holding mechanism and is secured in an end position, one arm of which is supported with its front side on a roller rotatably supported on the spring housing, for example on an extension of the same. In this manner, the precision of the reaction of the holding mechanism to outside influences by the skier are considerably improved, since the friction occurring during a movement of one arm of the two-arm lever relative to the roller is extremely low.

In order to prevent in a particularly simple manner the arm of the two-arm lever from sliding off from engagement with the roller, for example, under the influence of vibrations during the skiing, the invention further provides that the two-arm lever in the skiing position engages, under the influence of a torsion spring, a stop provided on the holding mechanism. It has been proven to be preferable that one arm of the lever be constructed fork-shaped.

As it is known, the holding force acting in a vertical longitudinally extending center plane of the ski and which is to be overcome during a frontal fall, is to be approximately three times as great as the force in the horizontal plane, which must be overcome during a twisting fall. In order to meet these different torsional moments, various inventive solutions are offered. Thus it is possible in a ski binding, in which the spring of the holding mechanism acts through a piston onto a generally mushroom-shaped follower member, to support the housing of the holding mechanism so that it is swingable to all sides, for the stem of the follower member to inventively have at an axial spacing therebetween two spherical ball-shaped portions, one of which is guided in a horizontally extending guide and the other in a vertically extending groove or guide of a ski-fixed fitting, and for the two-arm lever to rest on a transversely extending bolt of a piston.

A different embodiment of a ski binding, in which the spring of the holding mechanism acts through at least one piston onto a generally mushroom-shaped follower member swingably supported for movement to all sides in the housing of the holding mechanism, is inventively characterized (1) by the stem of the follower member having a spherical end guided in a bore of a ski-fixed fitting, and (2) by two pistons which are guided in or on one another and which engage the backside of the follower member, one piston of which is loaded by a first pressure spring for a release in the horizontal plane and the other piston by a second pressure spring for a release in the vertical plane.

Springs which are separate for both torsional moments are hereby utilized to facilitate an easier adjustment to the capabilities and the constitution of the skier. In order to be able to carry out an adjustment of the initial tension of the two springs, the invention provides that the two springs are housed in a rocker arm which is pivotally supported for movement about a transversely extending axis in the holding mechanism. The angular position of the rocker arm can be changed by an adjusting screw. Levers are swingably supported between the springs and the pistons in the holding mechanism. These levers engage the backside of the coaxially arranged pistons. These intermediate levers assure a satisfactory transfer of the spring force at different angular positions of the spring housing.

Furthermore the invention provides that the inner piston carries on its front side a horizontal control bar, whereas the outer piston has two control projections. The centers or axes of the pistons lie in a common vertical plane. Further, the ends of the control projections and of the control bar lie, in the normal position of the holding mechanism, in a plane which is perpendicular to the axis of the hole. These characteristics assure—regardless whether a frontal fall, a twisting fall or a combination fall occurs—a satisfactory transfer of the release force from the follower member to the two-arm lever. Furthermore in this embodiment, one arm of the two-arm lever is bifurcated and each leg engages simultaneously two shoulders on the two pistons. Through this the two-arm lever is swung always when one or the other or both pistons are moved against the force of the springs.

BRIEF DESCRIPTION OF THE DRAWINGS

The drawings illustrate exemplarily embodiments of the inventive release bindings, in which.

DETAILED DESCRIPTION

Figure 1:
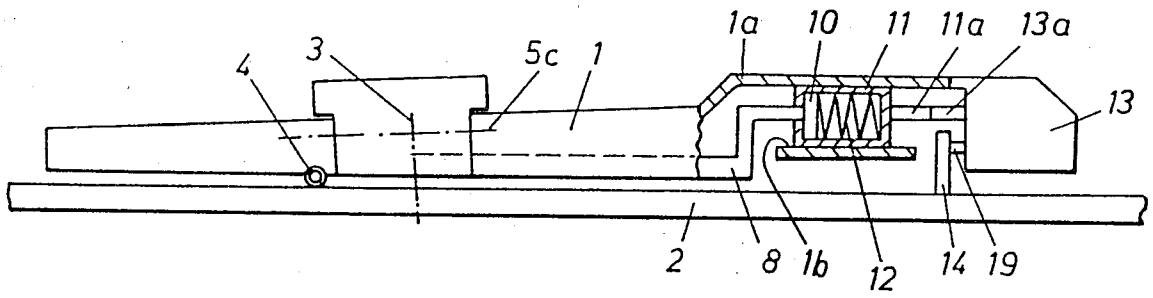
FIG. 1 is a partially sectioned side view of a release binding embodying the invention.
Figure 2:
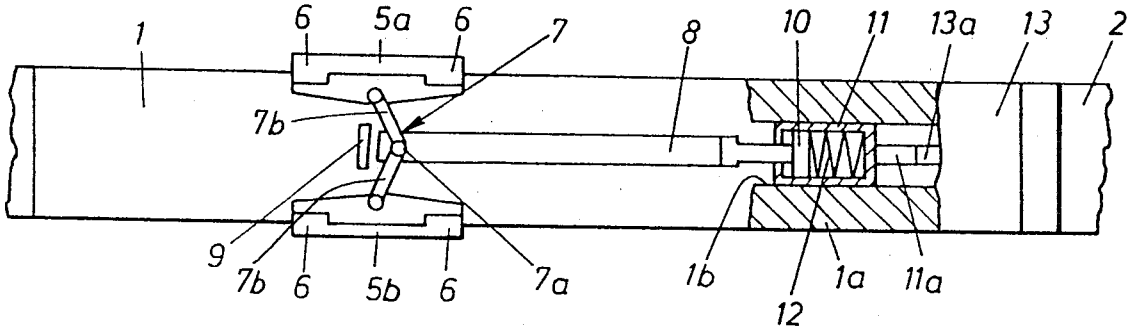
FIG. 2 is a partially sectioned top view of FIG. 1.

The release ski binding which is illustrated in FIGS. 1 and 2 has a sole plate 1, which is pivotally supported on the ski 2 for movement about a vertically upright axis 3 and about a horizontal axis 4 in a conventional manner which is not illustrated in any specific detail. The swivel axes 3 and 4 are horizontally spaced from one another. Two two-arm levers 5*a* and 5*b* are hingedly connected to the two side surfaces of the sole plate 1 for pivotal movement about substantially horizontal axes 5*c*. The upper arms of each lever have jaws 6 mounted thereon, which hold the ski shoe, not illustrated, therebetween. The lower arms, however, are connected through a toggle-joint mechanism 7 comprising a pair of toggle levers 7*b* and a toggle joint 7*a* which connects the adjacent ends of the levers 7*b* to a pressure rod 8. A stop 9 is provided adjacent the forward end of the pressure rod 8 to prevent the two toggle levers 7*b* of the toggle-joint mechanism 7 from moving beyond their extended position.

A piston 10 is connected to the other end of the pressure rod 8, which piston is movably guided in a spring housing 11 and is loaded or biased on one side thereof by a pressure spring 12. The spring housing 11 is movably supported for reciprocal movement in a guide track 1*b* on a housing structure 1*a* on the sole plate 1. The spring housing 11 has on the end thereof which is remote from the pressure rod 8 an extension 11*a*. A holding mechanism 13 is provided on the housing structure 1*a* of the sole plate 1, the operating member 13*a* of which engages in the skiing position, the extension 11*a* of the spring housing 11. A ski-fixed fitting 14 is provided beneath the operating member 13*a*, on which fitting is supported a follower member 19 of the holding mechanism 13. The mechanism for facilitating a stepping into the binding and the mechanism for facilitating a voluntary release of the jaws 6 are not illustrated in the drawing for clarity purposes.

This release ski binding operates as follows: The sole plate 1 can pivot both about the vertical axis 3 and also about the horizontal axis 4 in the so-called elastic region of the ski binding. The ski shoe is thereby held by and between the jaws 6. If, however, the elastic range is exceeded in one or two directions, the follower member 19 then experiences such a strong deflection that the operating member 13*a* slides off from the extension 11*a* of the spring housing 11, which results in a relaxing of the pressure spring 12 and a movement of the spring housing 11 rearwardly to effect an opening of the toggle-joint mechanism 7. The ski shoe can now press the jaws 6 into the open position and then leave the ski binding.

Figure 3:
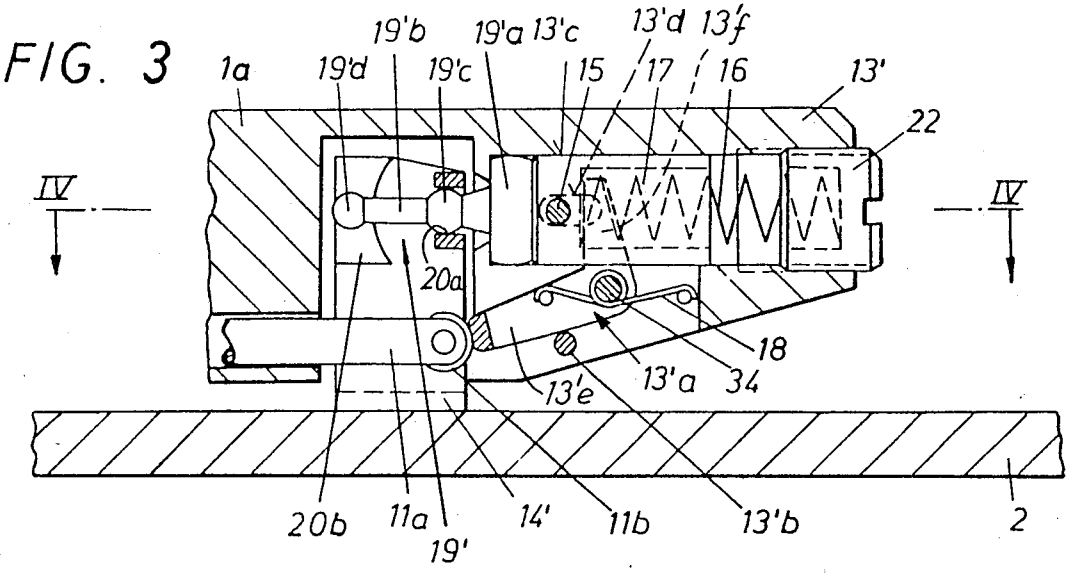
FIG. 3 is a vertical longitudinal cross section of a first embodiment of a holding mechanism.
Figure 4:
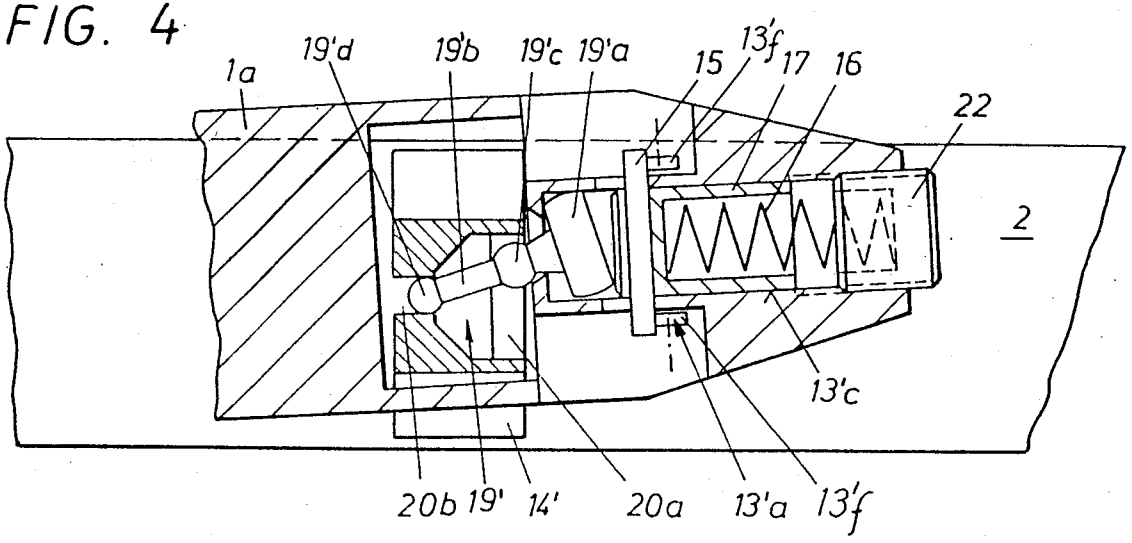
FIG. 4 is a sectional view taken along the line IV—IV of FIG. 3 and with the sole plate swung to an angle relative to the longitudinal axis of the ski.

In the holding mechanism 13′ which is illustrated in FIGS. 3 and 4, the operating member is in the form of a two-arm lever 13′*a* which is pivotal about an axle 34 and is loaded by a torsion spring 18. One arm 13′*e* engages the extension 11*a* of the spring housing 11 and the torsion spring 18 maintains it in engagement with a stop 13′*b* provided on the holding mechanism 13′. The extension 11*a* has a roller 11*b* on the end thereof engaging the arm 13′*e* for reducing the friction therebetween. The other arm 13′*f* of the two-arm lever 13′*a* is bifurcated and each leg engages an associated end of a bolt 15, which extends through slotted holes 13′*d* in the holding mechanism 13′. A hollow tubular piston 17, which is engaged on one side thereof by one end of a pressure spring 16 received in the hollow tubular part, is movably guided in a longitudinally extending guide track 13′*c* on the holding mechanism 13′. The tension of the pressure spring 16 can be adjusted by an adjusting screw 22 against which the other end of the spring 16 abuts.

A follower member 19′ has an enlarged head 19′*a* and a stem part 19′*b* which has a central ball-shaped part 19′*c* and an end ball-shaped part 19′*d* thereon. The head 19′*a* is swingably supported in the guide track 13′*c* provided on the holding mechanism 13′. The two enlarged ball-shaped portions 19′*c* and 19′*d* extend through an outwardly, forwardly diverging conical hole in the forward end of the guide track 13′*c*. The guide track is, in this embodiment, a blind hole in the holding mechanism 13′ opening outwardly at the rear thereof. A ski-fixed fitting 14′ has two horizontally spaced guideways thereon, namely a horizontally extending guideway 20*a* and a vertically extending guideway 20*b*, of which the guideway 20*a* guides the ball-shaped portion 19′*c* for horizontal movement and the guideway 20*b* guides the ball-shaped portion 19′*d* for vertical movement.

If during skiing the elastic range is exceeded in the horizontal or the vertical direction of the ski binding, that is, the holding mechanism 13′ on the rear end of the sole plate 1 moves relative to the ski-fixed fitting 14′, the follower member 19′ then swivels so much in the corresponding direction, that the bolt 15 is urged rearwardly to effect a clockwise rotative movement (in FIG. 3) of the lever 13′*a* to cause the arm 13′*e* to move upwardly away from the roller 11*b* of the extension 11*a* on the spring housing. Through this, the spring 12 which is housed in the spring housing 11 can relax, and the jaws 6 are permitted to open.

Figure 5:
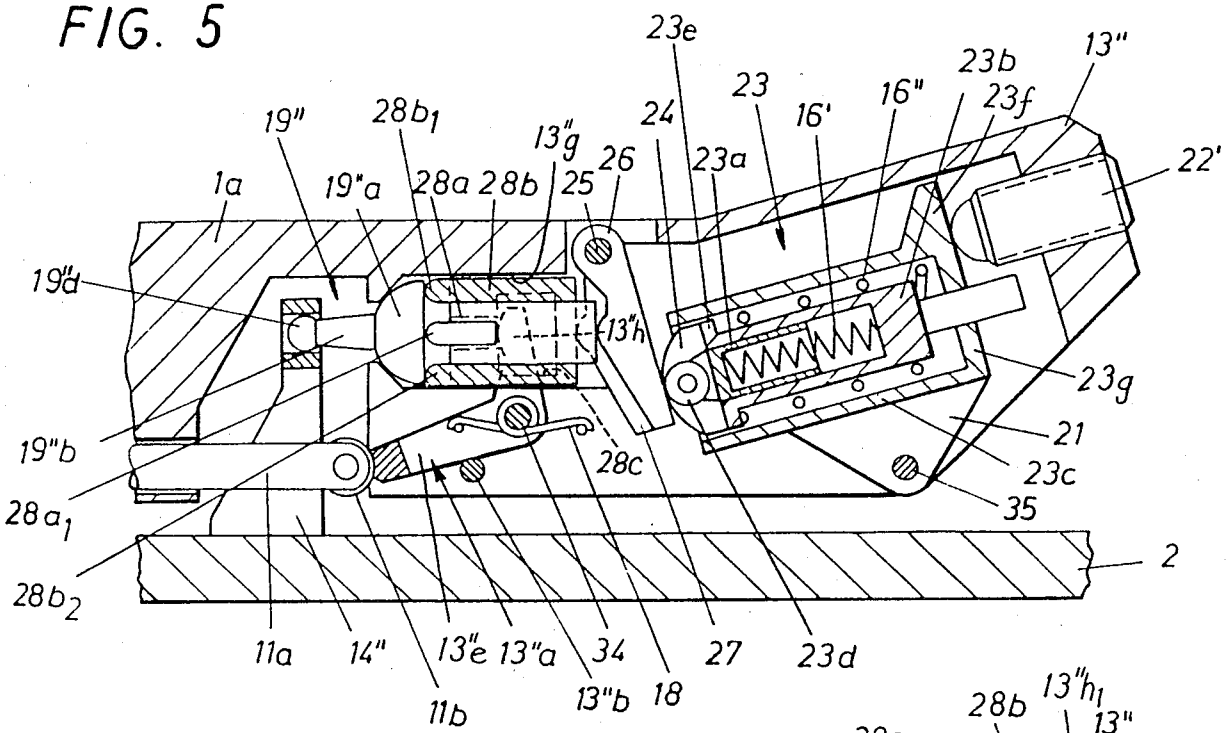
FIG. 5 is a vertical longitudinal cross section of a second embodiment of a holding mechanism.

In the holding mechanism 13″ according to FIG. 5, a two-arm lever 13″*a* which is biased in a counterclockwise direction (in FIG. 5) by a torsion spring 18, is provided and which functions as an operating member. One arm 13″*e* of the lever 13″*a* engages the rear end of the extension 11*a* on the spring housing 11 and is held in this position, due to the urging of the spring 18, by a stop 13″*b* in the form of a laterally extending bolt. In contrast to the embodiment of FIGS. 3 and 4, two concentric springs 16′ and 16″ are provided in the holding mechanism 13″, which springs are supported coaxially in a spring housing 23 mounted on a rocker arm 21. The spring housing will be described in more detail below. The spring 16′ serves to control the release in the horizontal direction and the spring 16″ serves to control the release in the vertical direction. The magnitude of the initial tension of the two springs 16' and 16'' will be influenced or controlled by controlling the initial position of the rocker arm 21. An adjusting screw 22' is for this purpose threadedly received in a threaded hole in the rear face of the holding mechanism 13''. The inner or forward end of the adjusting screw engages a shoulder 23*f* on the rocker arm 21.

The spring 16' is smaller in diameter than the spring 16'' and is housed in a telescopelike manner inside a hollow and tubular center part 23*b* of the spring housing 23. A piston 23*a* is slidably mounted in one end of the center part 23*b* and is engaged by one end of the spring 16'. The piston 23*a* has a roller 23*d* secured to the outwardly facing side thereof. The center part 23*b* of the spring housing 23 has a radially outwardly extending annular flange 23*e* thereon, which serves as an abutment for one end of the outer spring 16''. The center part 23*b* is slidably mounted in a central opening of an outer part 23*c* of the spring housing 23 against the urging of the spring 16'', the other end of which is abutted against a closed end wall 23*g* adjacent the shoulder 23*f*. Two laterally spaced, arc-shaped cam pieces 24 are attached to the flange 23*e* and straddle the roller 23*d*.

A transversely extending axle 25 is secured on a part of the holding mechanism 13'', which part is horizontally and forwardly spaced from the adjusting screw 22'. A one-arm lever 26 is centrally positioned on the axle 25. In addition, two one-arm levers 27 are provided, each on opposite sides of the central lever 26. Two coaxial pistons 28*a* and 28*b*, which are movable relative to one another, are supported in a longitudinally extending hole 13''*g* in the holding mechanism 13''. The center piston 28*a* has a horizontally extending control bar $28a_1$ thereon and the outer piston 28*b* has two control projections $28b_1$, $28b_2$, the forward edges thereof being coplanar and lying in a vertical plane extending perpendicular to the central axes of the pistons. The forward ends of the control projections $28b_1$, $28b_2$ and of the control bar $28a_1$ also lie, in the normal position of the holding mechanism 13'', in a plane which is perpendicular to the axis of the hole 13''*g* in the housing structure 1*a* on the sole plate (not shown in FIG. 5). Both pistons 28*a* and 28*b* are biased by the springs 16' and 16'' through the action of the levers 26 and 27.

A generally mushroom-shaped follower member 19'' is provided which has an enlarged head 19''*a*, a stem 19''*b* and a ball-shaped part 19''*d* on the end of the stem. The follower member 19'' is oriented at the end of the longitudinal hole 13''*g* in the housing structure 1*a*. The flat surface 19''*e* on the head 19''*a* of the follower member 19'' serves as the abutment for the control bar $28a_1$ and the control projections $28b_1$, $28b_2$. The ball-shaped end 19''*d* is supported in a hole in a ski-fixed fitting 14''. The arm 13''*h* of the lever 13''*a*, which arm is remote from the extension 11*a*, is bifurcated (see FIG. 5*a*), whereby each prong or leg $13''h_1$, $13''h_2$ engages both the rear edge of the control bar $28a_1$ of the inner piston 28*a* and also the edge of each of a pair of laterally spaced openings 28*c* in the side wall of the outer piston 28*b*.

Figure 5A:
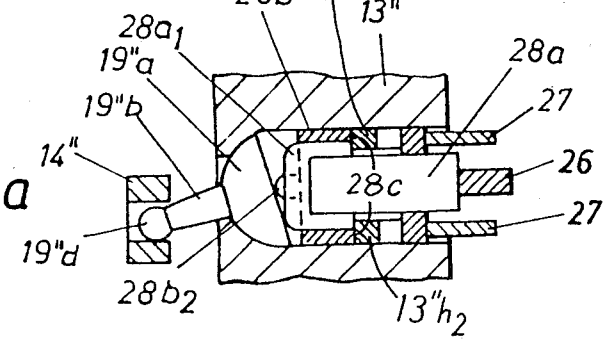
FIG. 5*a* is a partially sectioned top view of a detail of the holding mechanism of FIG. 5 and with the sole plate swung to an angle relative to the longitudinal axis of the ski.

If the sole plate is swung about the horizontal or vertical axes, the follower member 19'' is then swung to, for example, the FIG. 5*a* position to effect an axial movement of one or both of the pistons 28*a*, 28*b* against the spring force acting through the associated levers 26 and 27.

If the adjusted vertical and/or horizontal release moment of the sole plate is exceeded, the lever 13''*a* is then swung so strongly that it lifts off from the stop 13''*b* against the action of the torsion spring 18. Through this, the lever arm 13''*e* becomes disengaged from the roller 11*b* on the extension 11*a* of the spring housing. However, this has the consequence that the ski shoe becomes free from the binding in the already described manner.

The two springs 16' and 16'' are coupled in their action with one another in that during a compression of the inner spring 16', the center part 23*b* of the spring housing 23 is moved slightly rearwardly and during a compression of the outer spring 16'' the inner spring 16' is slightly relaxed. During a combined fall, during which both springs 16' and 16'' are compressed, each of the two releasing moments is therefore smaller than the sum of the individually occurring moments.

Of course the invention is not to be limited to the exemplary embodiments which are illustrated in the drawings and which are described above. Various modifications are conceivable without departing from the scope of the invention. For example, in place of compression springs, cup-spring-packages can be inserted into the holding mechanisms. Furthermore, in place of the roller on the extension on the spring housing, the extension could also have a rounded section with a low friction material coating same.

The embodiments of the invention in which an exclusive property or privilege is claimed are defined as follows:

1. In a release ski binding comprising a sole plate which in its central region is pivotal about a generally vertical axis and tilted up about a transverse horizontal axis which is arranged in front of said vertical axis, said sole plate being held on a ski in a skiing position by a resilient holding mechanism, said holding mechanism being responsive to a pivotal movement of said sole plate relative to the ski and, upon reaching a predetermined angle of traverse effecting an opening of a locking mechanism, comprising the improvement wherein said locking mechanism includes plural jaws on said sole plate movable between a ski shoe holding position and a ski boot releasing position, a locking member movably supported on said sole plate and being operatively coupled to said plural jaws to effect a movement of said jaws between the respective positions thereof in response to a movement of said locking member, a movement of said locking element in a first direction effecting a movement of said jaws into said ski shoe holding position, a spring housing movably supported on said sole plate, a spring mounted in said spring housing and control means for selectively controlling the urging by said spring of said locking member in said first direction for the purpose of effecting a movement of said jaws to said ski shoe holding position, wherein said control means includes a toggle lever pivotally supported on said sole plate about a further axis extending transversely to a longitudinal axis of said ski, wherein said spring housing has a surface means on a side thereof remote from said locking member, said toggle lever being adapted to engage said surface means to hold said spring housing and spring therein and said locking member at a position whereat said jaws are in said ski shoe holding position, wherein a piston means is provided which is reciprocally movable on said sole plate and operatively coupled to said toggle lever, and wherein a follower means is movably supported on said sole plate and is operatively coupled to said piston means, said follower means having a part thereon engaging a ski-fixed guide means so that movement of said sole plate about one or both of said horizontal axis and said vertical axis will cause said follower means to move relative to said sole plate and effect a movement of said piston means so that when said sole plate pivots to said predetermined angle of traverse, said piston means will move a sufficient distance to cause said toggle lever to disengage from said surface means to allow said jaws to move to said ski shoe releasing position.

2. The ski binding according to claim 1, wherein said toggle lever is a two-arm lever, wherein said surface means is an extension on said spring housing and a roller rotatably supported on an end of said extension remote from said spring housing, one arm of said toggle lever engaging said roller, the other arm of said toggle lever engaging said piston means.

3. The ski binding according to claim 2, wherein said two-arm lever is, in said ski shoe holding position, biased by a torsion spring into engagement with a stop on said holding mechanism.

4. The ski binding according to claim 2, wherein aaid other arm of said two-arm lever is fork-shaped.

5. The ski binding according to claim 2, wherein said follower means includes a generally mushroom-shaped follower member swivelably supported on said sole plate and to all sides, wherein said part is a stem part which has two axially spaced spherical ball portions thereon, of which one spherical ball is guided in a horizontal guide means and the other in a vertical guide means, both guide means being provided on said ski-fixed guide means.

6. The ski binding according to claim 1, wherein said follower means includes a generally mushroom-shaped follower member swivelably supported on said sole plate and to all sides, wherein said part is a stem part which has a spherical end part guided in a hole in said ski-fixed guide means, and wherein said piston means includes two pistons which are guided on one another, one of said pistons being loaded by a said first pressure spring for controlling a release in the horizontal direction and the other piston being loaded by a second pressure spring for controlling a release in the vertical direction.

7. The ski binding according to claim 6, wherein said first and second pressure springs are housed in a rocker arm which is pivotally supported for movement about a transverse axis on said sole plate, the angular position of said rocker arm being changeable by an adjusting screw on said sole plate.

8. The ski binding according to claim 6, wherein said pistons are coaxially arranged on said sole plate, and wherein a pair of levers are pivotally supported on said sole plate, said levers each engaging a one of said coaxially arranged pistons on a side remote from said follower member.

9. The ski binding according to claim 6, wherein one of said pistons has a horizontal control bar on its side adjacent said follower member, wherein the other piston has two control projections on its side adjacent said follower member, the axes of both pistons lying in a common vertical plane, the ends of the control projections and of the control bar also lying, in said ski shoe holding position, in a further plane which is perpendicular to said axes of said pistons.

10. The ski binding according to claim 4, wherein said follower means includes a generally mushroom-shaped follower member swivelably supported on said sole plate and to all sides, wherein said part is a stem part which has a spherical end part guided in a hole in said ski-fixed guide means, and wherein said piston means includes two pistons which are guided on one another, one of said pistons being loaded by a first pressure spring for controlling a release in the horizontal direction and the other piston being loaded by a second pressure spring for controlling a release in the vertical direction, and wherein each leg of said fork-shaped part of said two-arm lever engages both pistons simultaneously.

11. The ski binding according to claim 5, wherein said piston includes a crossbolt the ends of which project laterally from said piston, and wherein said other arm of said toggle lever is fork-shaped and engages said laterally projecting ends of said crossbolt.

* * * * *